US006793216B2

(12) United States Patent
Nakamura

(10) Patent No.: US 6,793,216 B2
(45) Date of Patent: Sep. 21, 2004

(54) SHEET MATERIAL CONVEYING DEVICE AND IMAGE FORMING APPARATUS PROVIDED WITH SUCH DEVICE

(75) Inventor: Takao Nakamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/242,598

(22) Filed: Sep. 13, 2002

(65) Prior Publication Data

US 2003/0057638 A1 Mar. 27, 2003

(30) Foreign Application Priority Data

Sep. 26, 2001 (JP) ..... 2001-292902

(51) Int. Cl.[7] ..... B65H 29/70; B65H 31/20; B65H 29/54

(52) U.S. Cl. ..... 271/188; 271/223; 271/306

(58) Field of Search ..... 271/188, 223, 271/306; B65H 29/70, 31/20, 29/54

(56) References Cited

U.S. PATENT DOCUMENTS 3,291,484 A * 12/1966 Gibb ..... 271/306
5,391,450 A 2/1995 Nagatsuka et al. ..... 430/99
6,424,000 B1 * 7/2002 Mehta ..... 257/314
6,446,962 B1 * 9/2002 Taffertshofer ..... 271/312
2001/0048192 A1 * 12/2001 Nishida et al. ..... 271/306

* cited by examiner

*Primary Examiner*—Donald P Walsh
*Assistant Examiner*—Kenneth W Bower
(74) *Attorney, Agent, or Firm*—Fitzpatrick, Cella, Harper & Scinto

(57) ABSTRACT

A sheet conveying device comprises a conveying mechanism for conveying a sheet material almost horizontally; and a supporting member movably attached to the conveying mechanism for supporting a sheet material, at least two or more supporting members being provided as aforesaid supporting member in the widthwise direction of conveyance substantially orthogonal to the conveying direction of sheet material, and at least one or more of the aforesaid supporting members being capable of supporting a sheet material in positions having different heights in the direction substantially perpendicular to the sheet material, and further, the positions of the aforesaid supporting members for supporting a sheet material being variable substantially in the same direction as the conveying direction of sheet material.

21 Claims, 17 Drawing Sheets

SHEET MATERIAL CONVEYING DEVICE AND IMAGE FORMING APPARATUS PROVIDED WITH SUCH DEVICE

BACKGROUND OF THE INVENTION

1. Field of the Invention

The present invention relates to an image forming apparatus having the function of images formation on a recording material, and a conveying device for conveying a sheet material, which is provided for such apparatus.

2. Related Background Art

In the conventional ink jet recording apparatus (FIG. 14), a sheet material is fed from a sheet feeding portion 2 to a conveying portion 3 one by one, and conveyed to a position that faces a recording head 7. The recording head 7 performs ink jet recording on the sheet material P, which is mounted on a carriage reciprocating in the direction orthogonal to the conveying direction of the sheet material P. When the sheet material P is conveyed to the position facing the recording head 7, the recording head 7 discharges ink in accordance with recording information transmitted from a personal computer or the like, which is arranged externally, thus performing recording on the sheet material P placed on a platen 34.

Then, the structure is arranged so that the sheet P on which recording has been completed is expelled by use of an expeller roller 41 and a spur 42, which is a rotational body in point contact with the sheet P, arranged for the sheet expelling portion 4, thus conveying the sheet material to the expelled-sheet tray 70, which is installed on the downstream side of the recording apparatus, and stack it thereon.

In this conventional ink jet recording apparatus, however, when a sheet material P is expelled after recording and stacked on the expelled-sheet tray 70, the recorded image on the sheet material P, which has been already stacked on the expelled-sheet tray 70, may be disturbed by rubbing of sheet materials P themselves if ink on the recorded surface of such preceding sheet material p is yet to be dried.

Now, therefore, there is a device made available for retaining sheet materials in the expelled-sheet stacker arranged on the downstream of the expeller roller pair 41 and 42, which uses elongated guide members, as shown in FIGS. 15A and 15B, for example. Here, as shown in FIG. 15A, recording is made on the sheet material 114, while being held by the guide members 131. Then, with the completion of recording, the guide members 131 are released (FIG. 15B) so that the sheet material is stored on the expeller stacker 130. With this device, it is possible to deal with the aforesaid problem more reliably.

The arrangement of this device, however, makes the recording apparatus itself very large inevitably, and when dealing with sheets in various sizes, the sheet edge guide members of the sheet stacker should be made movable in the direction at right angles to the sheet conveying direction. As a result, there are problems yet to be solved, such as increased costs and slower recording speed, among some others.

With a view to solving these problems, there is a device that uses an expelled-sheet support 160 on the downstream of the expeller roller pair 41 and 42, which can be protruded in the sheet conveying direction as disclosed in the specification of Japanese Patent Application Laid-Open No. 11-268359, for example. FIG. 16 and FIG. 17 are views that illustrate the operation of the expelled-sheet support 160.

The expelled-sheet support 160 is arranged in a plural number in the widthwise direction of conveyance orthogonal to the conveying direction, and protruded as shown in FIG. 16 when the leading end of a sheet material P, which has been expelled in the horizontal direction, passes the expeller roller pair 41 and 42. Here, the sheet material P is expelled, while being supported by the expelled-sheet support 160 more in the upward direction than the horizontal, and held in the air until the leading end of the sheet material P hangs down and contacts with the expelled-sheet tray 70. After that, when the trailing end of the sheet material P passes the expeller roller pair 41 and 42, it is drawn in the direction opposite to the sheet conveying direction, and the sheet material P is stacked on the expelled-sheet tray 70 as shown in FIG. 17.

In this way, it is made possible to solve the aforesaid problems, while dealing with the recording performance on sheet in various sizes, without making the recording apparatus itself larger. Nevertheless, since a sheet material P is supported by the expelled-sheet support 160 more in the upward direction than the horizontal, there may be some cases where adverse effect is produced on the recording quality, because it is ideal for a recording apparatus that the passage of a sheet material P is horizontal.

Also, depending on the kinds of sheet material P, such as a thick specially treated sheet capable of performing high quality recording thereon, for example, there is almost no problem that ink yet to be fixed is rubbed immediately after recording as described above. By the utilization of this property, it is possible to maintain high-quality recording when recording is made on a specially treated paper or the like without the protrusion of the expelled-sheet support 160 or some other measures.

In recent years, however, the kinds of specially treated sheet dedicated to use for ink jet recording have become various, and materials used for the layers that form such sheet material are also different. As a result, the behavior of a sheet material immediately after recording is various depending on the thickness, firmness, degree of ink absorption, and only the protruding and retraction operation of the expelled-sheet support 160 is no longer good enough for dealing with each of the sheet materials P appropriately.

Particularly, in recent years, an ink jet recording apparatus is made to perform high-speed recording along with the advancement of the manufacturing technologies and techniques of an ink jet recording head, which makes the provision of multiple nozzle possible, with the advancement of the ink jet recording technologies and techniques, which makes it possible to deal with high-frequency discharge signals, and along with the high-speed processing of recording data, which is made possible by the availability of inexpensive storage device. As a result, recording time per sheet becomes shorter, and the tendency is that the next sheet material is expelled in a state where most of ink immediately after recording is yet to be fixed, thus making it easier for ink rubbing to occur. Also, it is assumed that the ink material, which is not easy to be dried, is even adopted for an ink jet recording apparatus for recording images in high-density with high coloring. Therefore, it is prerequisite more than ever that measures be taken to solve the aforesaid problems.

SUMMARY OF THE INVENTION

It is an object of the present invention to provide a sheet conveying device capable of preventing image quality from being degraded due to rubbing of ink yet to be fixed on the sheet material that has been expelled last by a sheet material being expelled following it, and also, to provide an image forming apparatus provided with such device.

It is another object of the invention to provide a sheet conveying device capable of forming an optimal curve for a sheet material in accordance with the size, material, thickness, and others of the sheet material in order to prevent image quality from being degraded due to rubbing of ink yet to be fixed on the sheet material that has been expelled last by a sheet material being expelled following it, and also, to provide an image formatting apparatus provided with such device.

It is still another object of the invention to provide a sheet conveying device, which comprises a conveying mechanism for conveying a sheet material almost horizontally; and a supporting member movably attached to the conveying mechanism for supporting a sheet material, at least two or more supporting members being provided as aforesaid supporting member in the widthwise direction of conveyance substantially orthogonal to the conveying direction of sheet material, and at least one or more of the aforesaid supporting members being capable of supporting a sheet material in positions having different heights in the direction substantially perpendicular to the sheet material, and further, the positions of the aforesaid supporting members for supporting a sheet material being variable substantially in the same direction as the conveying direction of sheet material, and also, to provide an image forming apparatus provided with such device.

DETAILED DESCRIPTION OF THE PREFERRED EMBODIMENTS

Hereinafter, with reference to the accompanying drawings, the detailed description will be made of the mode embodying the present invention in accordance with plural embodiments.

(First Embodiment)

Figure 1:
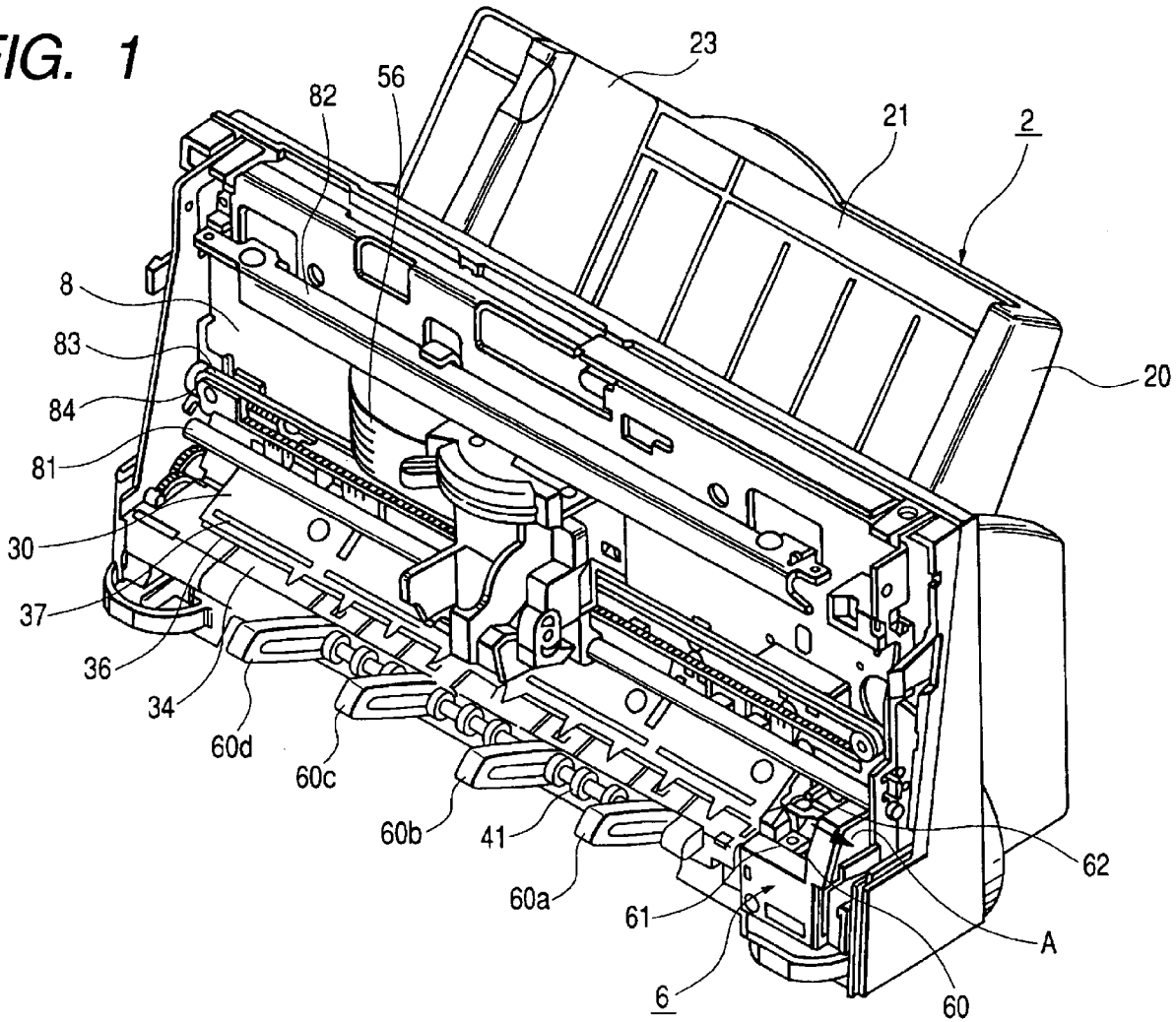
FIG. 1 is a perspective view that schematically shows one example of the entire structure of an image forming apparatus as a first embodiment in accordance with the present invention.
Figure 2:
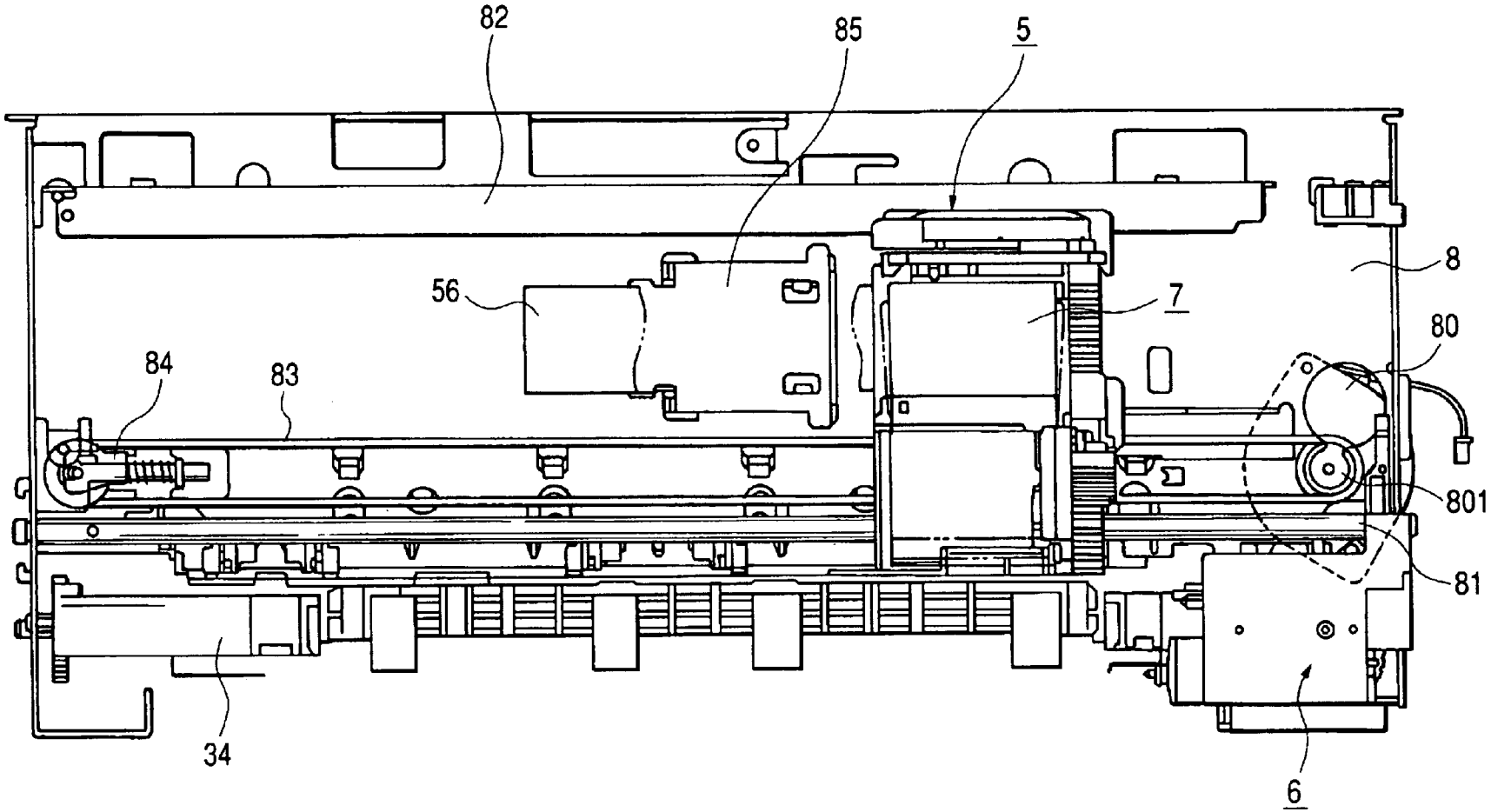
FIG. 2 is a front view that schematically shows the image forming apparatus represented in FIG. 1.
Figure 3:
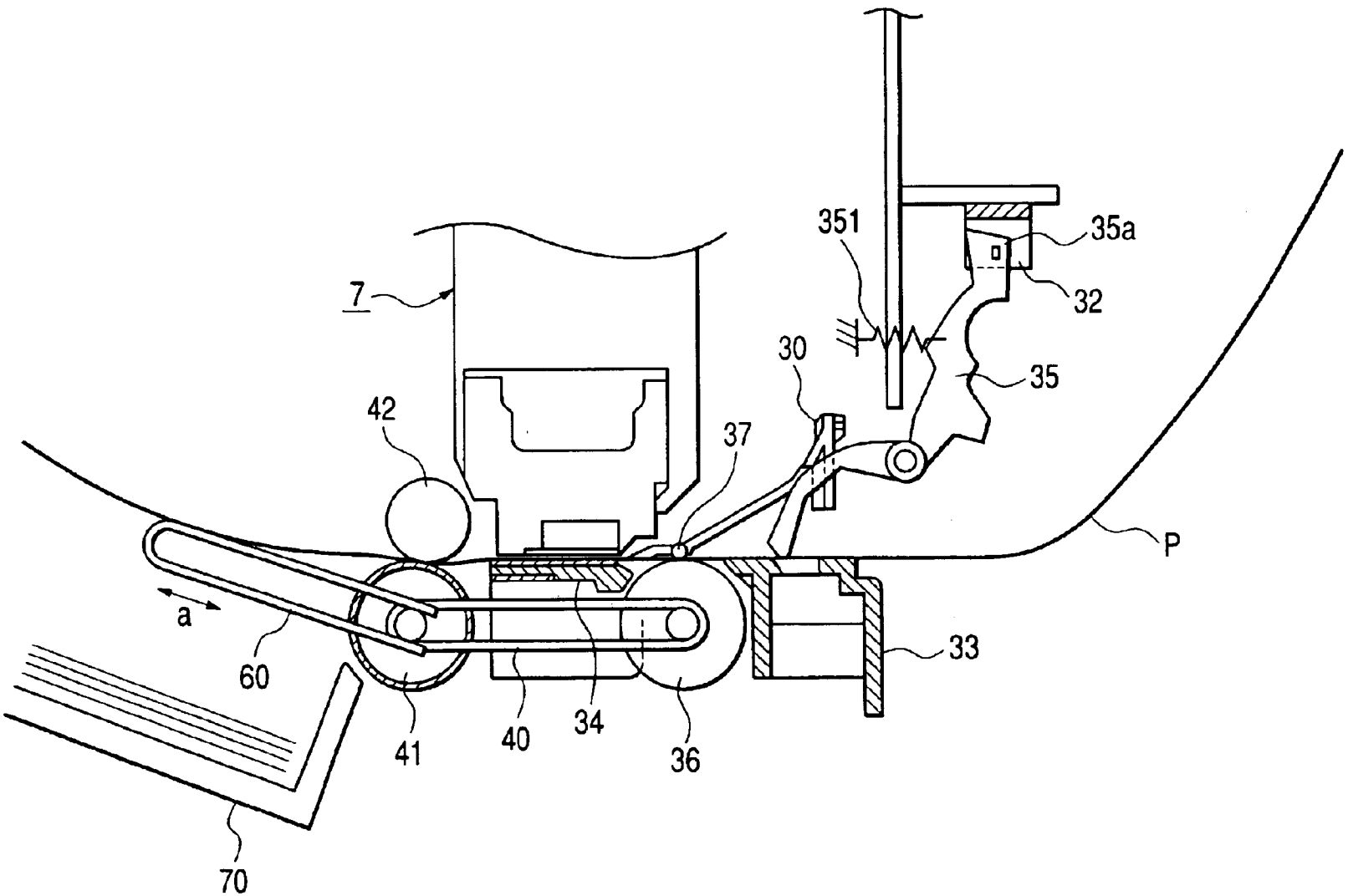
FIG. 3 is a cross-sectional view that schematically shows the image forming apparatus in accordance with the first embodiment.

FIG. 1 is a perspective view that schematically shows one example of the entire structure of an image forming apparatus as a first embodiment in accordance with the present invention. FIG. 2 is a schematic front view, and FIG. 3 is a schematically sectional—sectional view thereof. In this respect, an ink jet type printer is described as the example of the image forming apparatus in accordance with the first embodiment.

The image forming apparatus shown in FIG. 1 to FIG. 3 briefly comprises a sheet feeding unit 2, a sheet conveying unit 3, a sheet expeller unit 4, which corresponds to the sheet material conveying device embodying the present invention, a carriage unit 5, and a cleaning unit 6.

The sheet conveying unit 3 is provided with a conveying roller 36, which is a rotating carrier member contained in conveying means for conveying a sheet material P, and an optical PE sensor 32 that detects the edges of the sheet material P (hereinafter referred to as PE).

A pinch roller 37 is held by a pinch roller guide 30, and being biased by a pinch roller spring 31, the pinch roller 37 is pressed to the conveying roller 36, thus generating force to convey the sheet material P.

Further, at the entrance of the sheet conveying unit 3 where the sheet material P is conveyed, a lower guide 33, which guides the sheet material P, and a platen 34 are provided. Also, for the lower guide 33, a PE sensor lever 35 is provided to transmit the detection of leading end or trailing end of a sheet material P to the PE sensor 32.

On the downstream side of the conveying roller 36 serving as the rotating carrier member in the conveying direction of a sheet material P, there is arranged the recording area for forming images in accordance with image information. The recording head 7 is arranged therein.

In the structure described above, the sheet material P, which has been fed to the sheet conveying unit 3, is guided by the platen 34 and the lower guide 33, and fed to the gap between the conveying roller 36 serving as the rotating carrier member and the pinch roller 37 (hereinafter referred to "conveying roller pair").

At this juncture, the PE sensor lever 35 detects the leading end of the sheet material P in conveyance, thus obtaining the recording position of the sheet material P so as to set timing at which the sheet is conveyed to the recording position, and also, correct the leading end of the sheet material P to an appropriate position as required.

The sheet material P is being conveyed on the platen 34 by the rotation of the conveying roller pair driven by a carrier motor (not shown). In this respect, an ink tank and an ink jet recording head constitute the recording head 7.

The recording head 7 is made to be able to give heat to ink by the heater or the like, which serves as electrothermal converting element. Then, film boiling is generated in ink by the application of such heat, and ink is discharged from the nozzle of the recording head 7 by the pressure changes, which are made by the development and contraction of bubble generated by the film boiling, thus forming images on the sheet material P.

In FIG. 3, a belt 40 engages with the conveying roller 36 serving as the rotational carrier member in the sheet expeller unit 4, and also, engages with the expeller roller 41 serving as the rotational carrier member.

The sheet material P is expelled from the expeller roller pair in the horizontal direction, and it is expelled, while being held by the expelled-sheet support 60 almost horizontally. After that, it is stacked on the expelled-sheet tray 70.

Further, the detailed description will be made of the sheet expeller unit 4.

With the rotation of a carrier motor (not shown), the conveying roller 36 serving as the rotational carrier member is driven to rotate, while driving the expeller roller 41 serving as the rotational carrier member to rotate. Here, a spur 42, a driven rotational member, which can rotate following the expeller roller 41 serving as the carrier member, is arranged in a position to face the expeller roller 41 serving the rotational carrier member.

Also, as shown in FIG. 3, there is arranged the expelled-sheet support 60, which is provided with a rack gear (not shown), in order to hold the sheet material P expelled from the expeller roller pair 41 and 42. Here, a pinion gear (not shown), and a solenoid and a stepping motor (not shown) that drive the pinion gear per expelled sheet support 60 are arranged, and with the rotation of the pinion gear, the expelled-sheet supports are made movable in the directions indicated by a double-headed arrow a as shown in FIG. 3.

With this structure, the sheet material P after images are formed thereon by the recording head 7 is nipped by the expeller roller pair 41 and 42 and conveyed, while being supported by the expelled-sheet support 60. Then, it is expelled onto the expelled-sheet try 70 (not shown).

Figure 4:
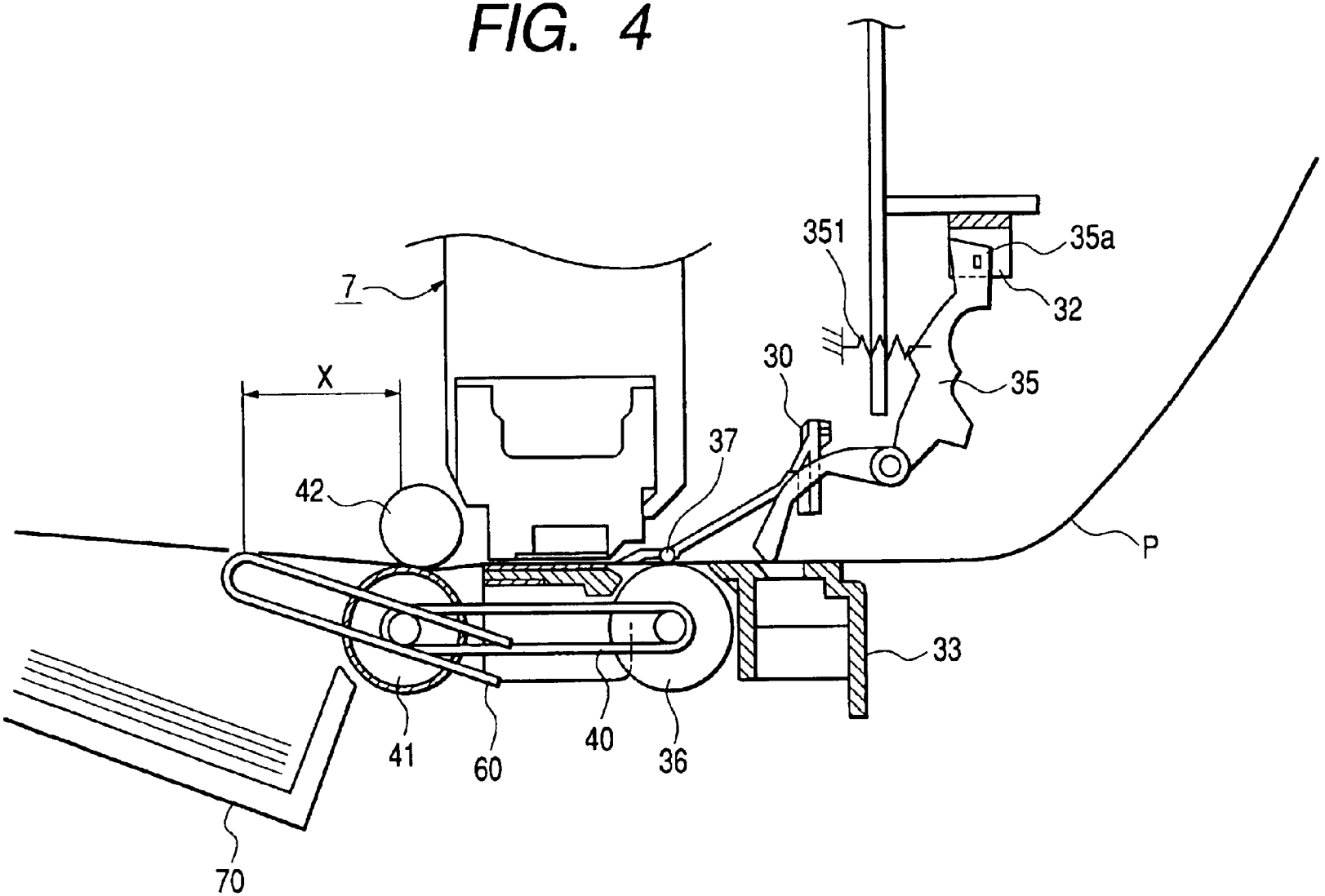
FIG. 4 is a cross-sectional view that, schematically shows the image forming apparatus in accordance with the first embodiment.
Figure 5:
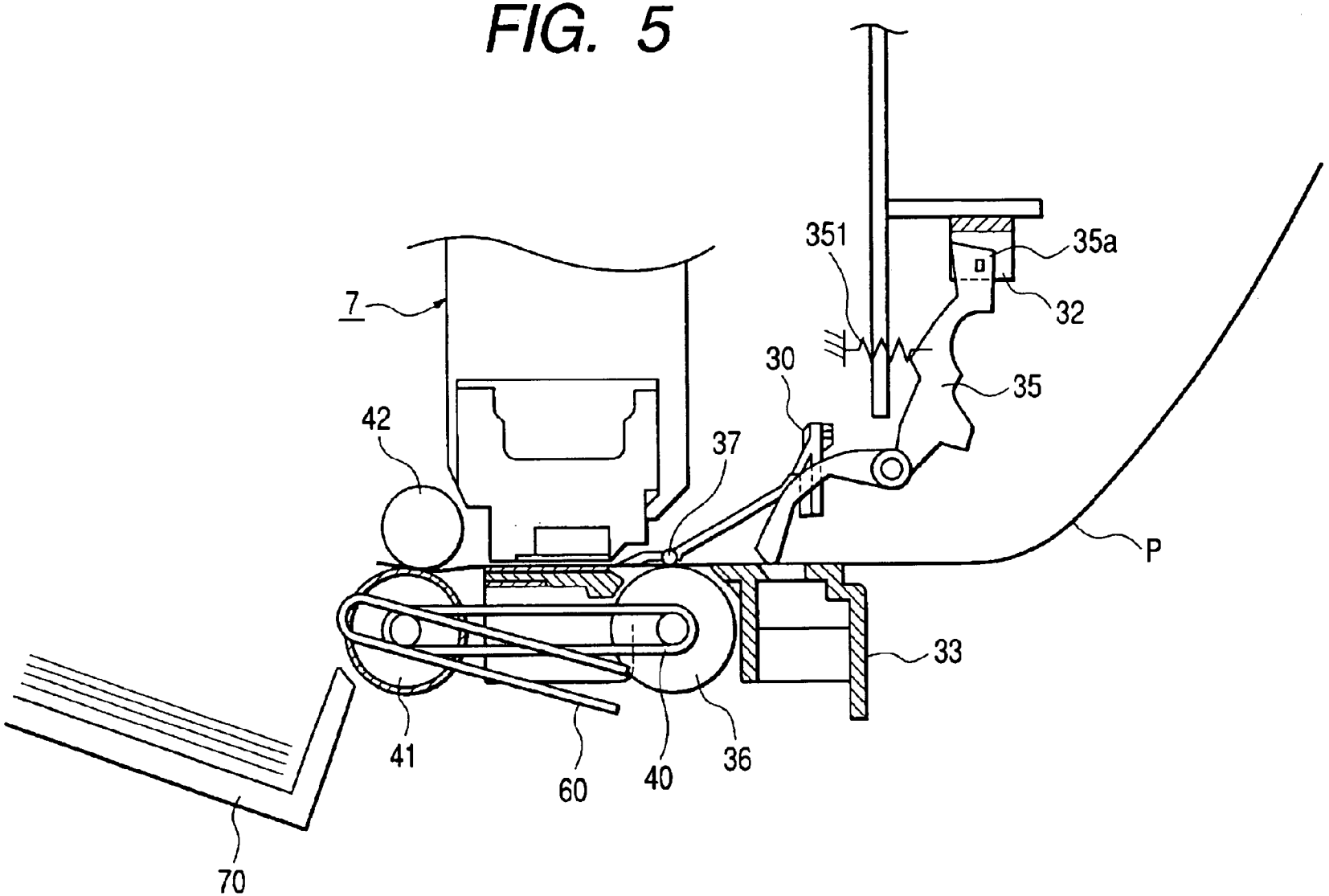
FIG. 5 is a cross-sectional view that schematically shows the image forming apparatus in accordance with the first embodiment.

In a state where no sheet material P is fed from the sheet-feeding unit 2, the PE sensor lever 35 is usually biased by the lever spring 351 downward in FIG. 4 to a position shown in FIG. 4. At this juncture, the PE sensor 32 is turned off.

When a sheet material P is fed from the sheet-feeding unit 2, the PE sensor lever 35 is pushed up against the spring force of the lever spring 351 so that the shielding portion 35*a* of the PE sensor lever 35 shields the PE sensor 32. In this way, the leading end of the sheet material P is detected, and then, from the position where such detection is made, the sheet material P is conveyed in a designated amount to an appropriate position by the rotation of the conveying roller pair, hence recording and others being started.

The leading end of the sheet material P thus conveyed by the conveying roller pair is conveyed in due course to the expeller roller 41 serving as rotational carrier member, and the spur 42 driven to follow the rotation thereof (hereinafter referred to as the expelled-sheet roller pair). Then, it is being conveyed by the conveying force of the conveying roller pair, and the conveying force of the expelled-sheet rotation pair 41 and 42, which is smaller than that of the conveying roller pair.

Figure 13:
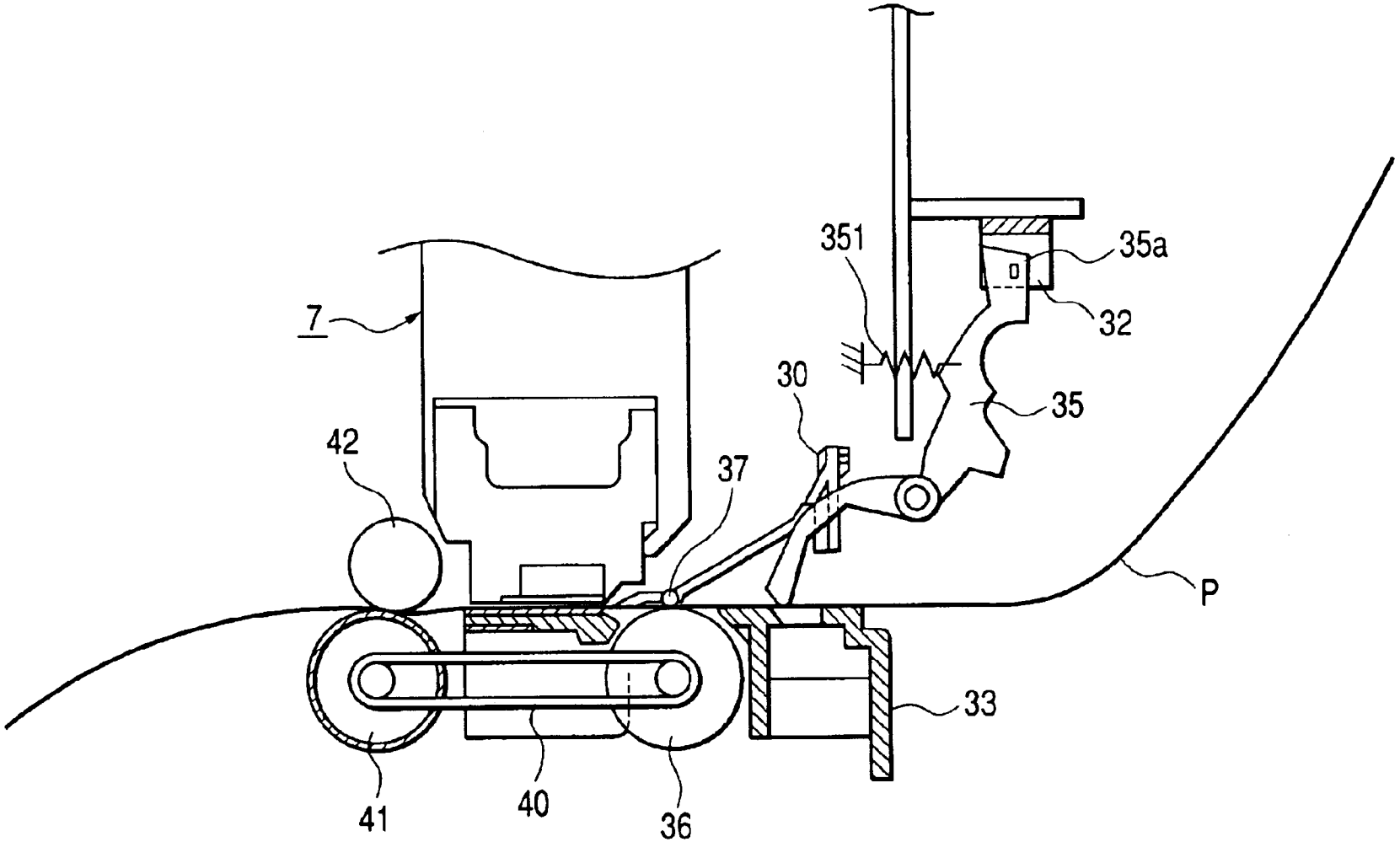
FIG. 13 is a cross-sectional view that schematically shows one example of the entire structure of the conventional image formation apparatus, which is not provided with any expelled-sheet support.
Figure 14:
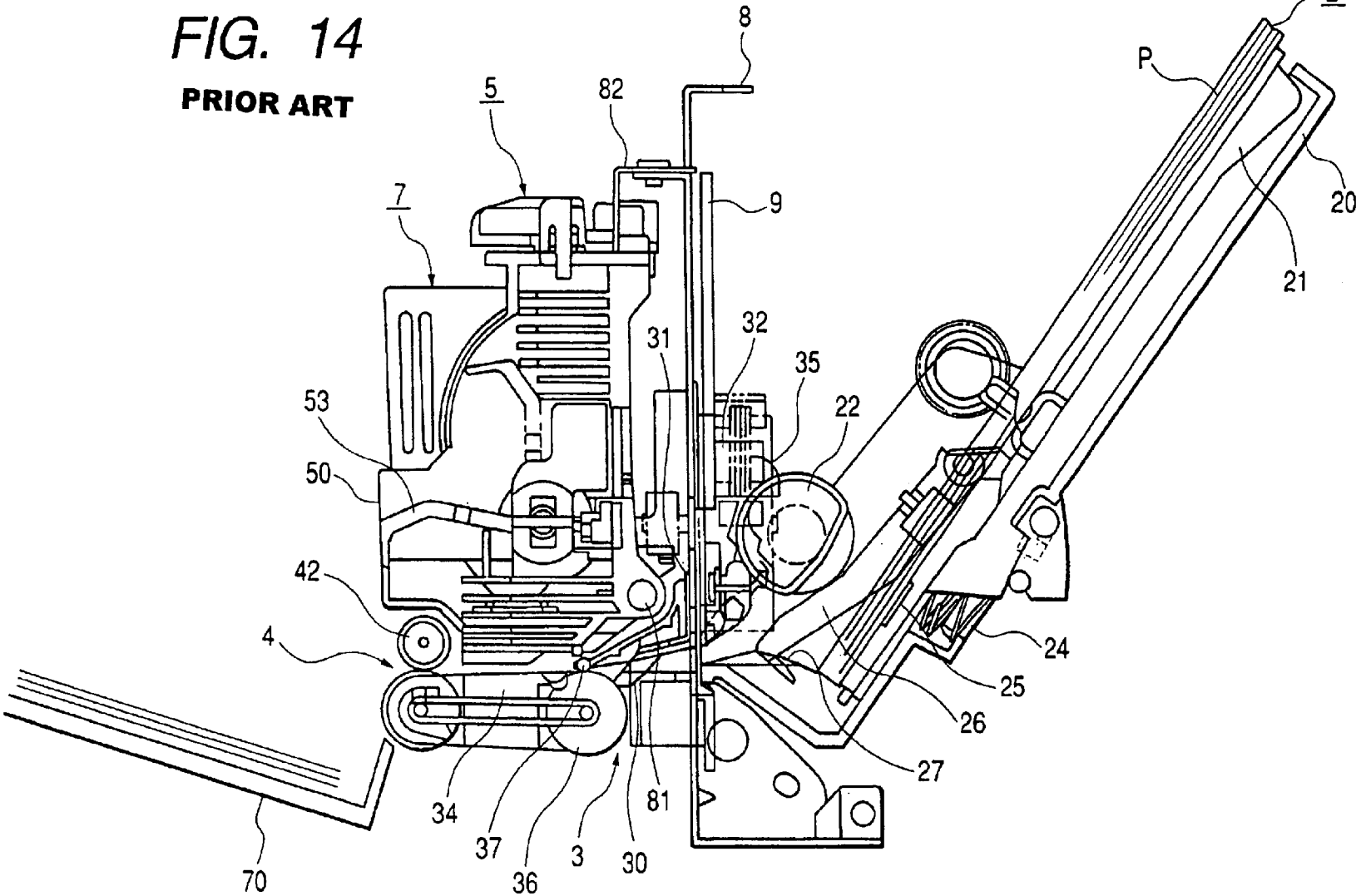
FIG. 14 PRIOR ART
FIG. 14 is a cross-sectional view that schematically shows the entire structure of the image formatting apparatus represented in FIG. 13.
Figure 15A:
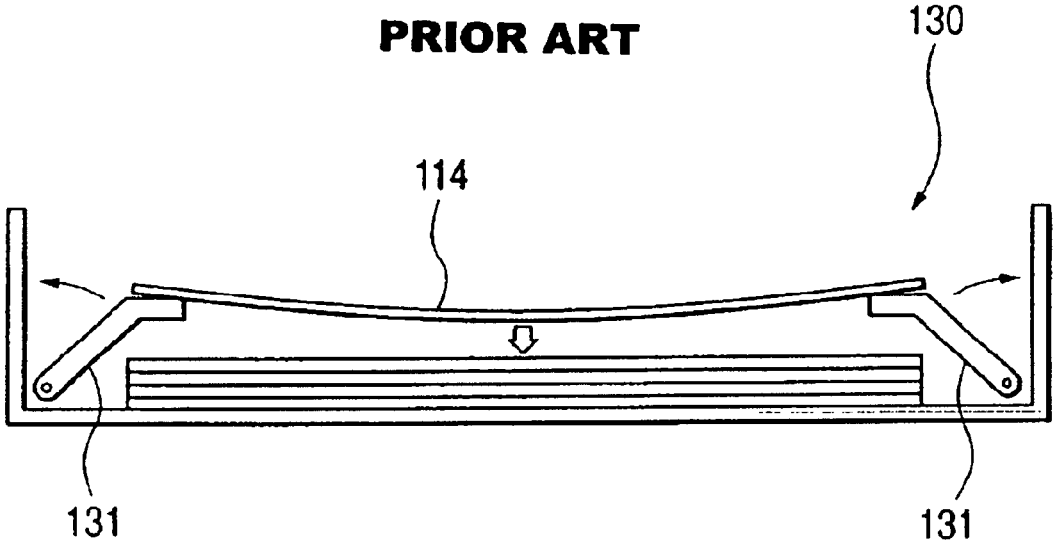
FIG. 15A PRIOR ART
FIGS. 15A and 15B are front views that schematically shows a part of the image formatting apparatus, which uses the conventional expeller stacker.
Figure 15B:
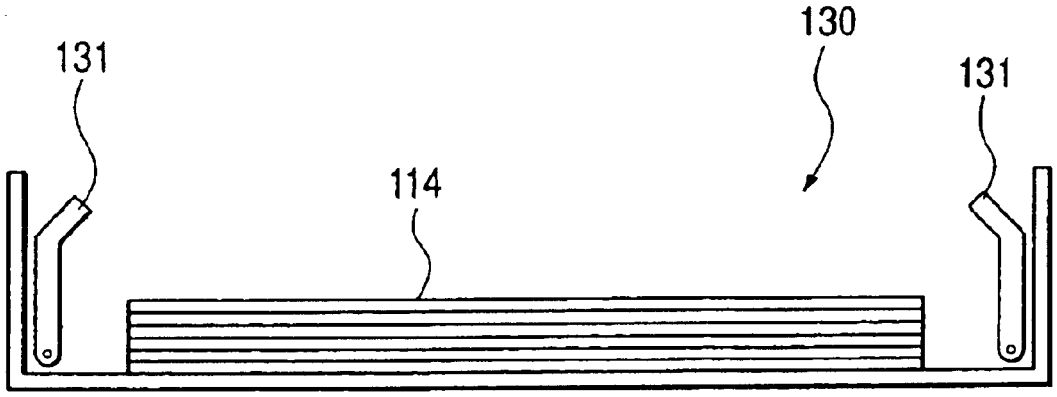
FIG. 15B PRIOR ART
Figure 16:
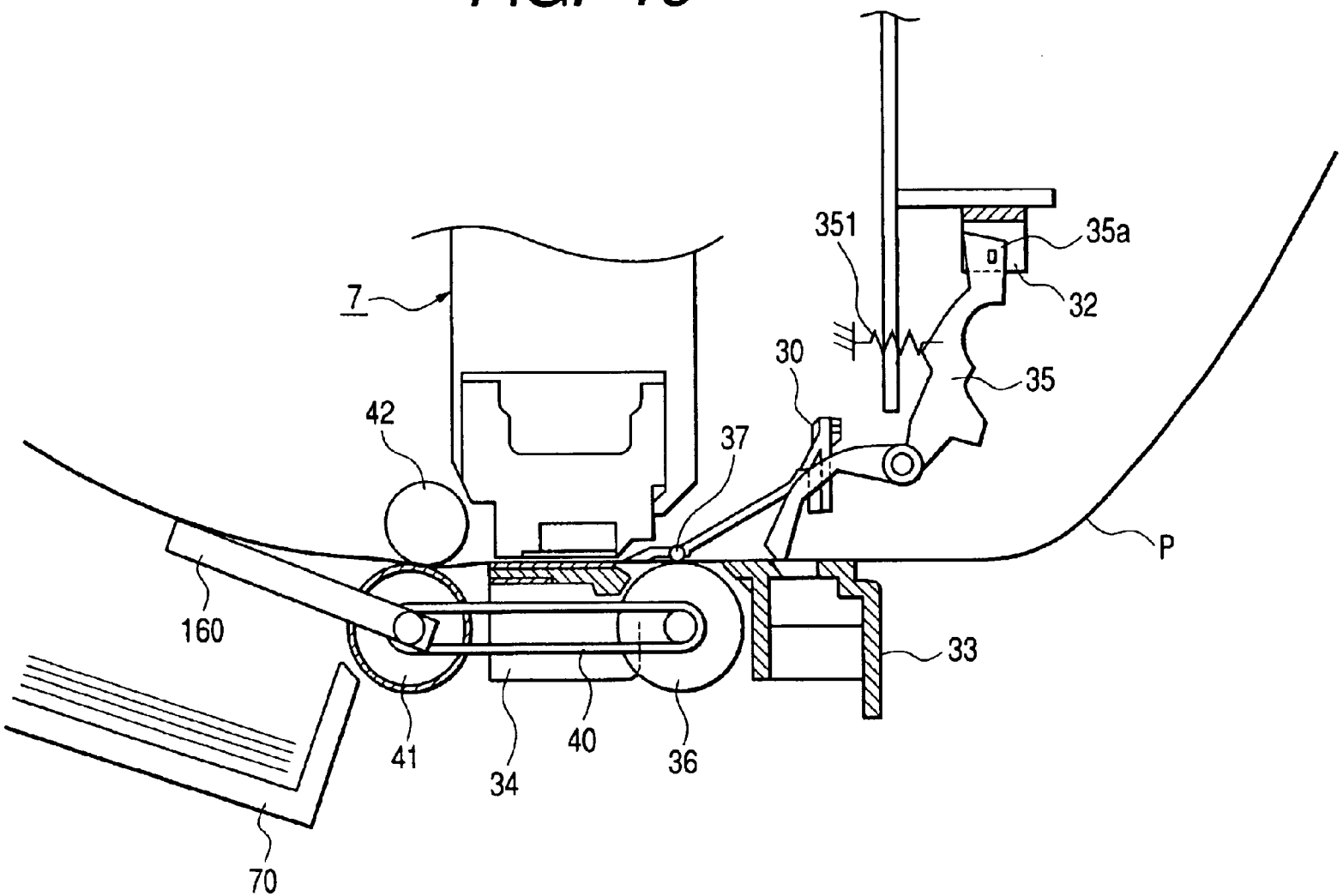
FIG. 16 is a cross-sectional view that schematically illustrates the image forming apparatus, which uses the conventional expelled-sheet support.
Figure 17:
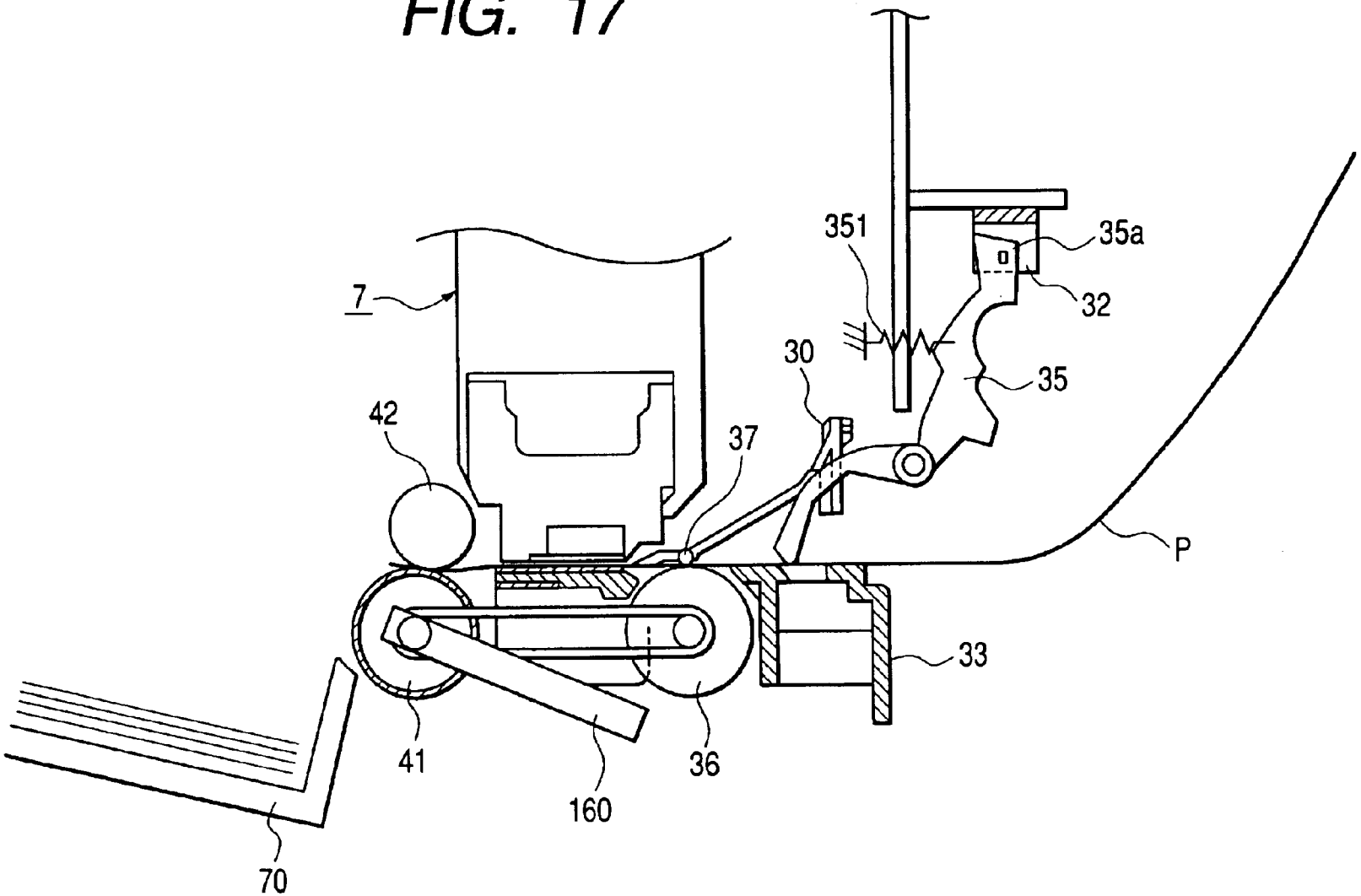
FIG. 17 is a cross-sectional view that schematically illustrates the image forming apparatus, which uses the conventional expelled-sheet support.

When the leading end of the sheet material P has passed the expeller roller pair 41 and 42, it looses means for supporting the leading end of the sheet material P. Then, as shown in FIG. 13, the leading end of the sheet material P hangs down toward the lower part by the own weight of the sheet material P. When the leading end of the sheet material P is conveyed for a specific distance after it has passed the expeller roller pair 41 and 42, the expelled-sheet support 60 is protruded at a designated timing as shown in FIG. 3.

FIG. 1 shows the example in which four expelled-sheet supports 60*a*, 60*b*, 60*c*, and 60*d*, each of which is in the same configuration as that of the expelled-sheet support 60. The four expelled supports 60 are made operative individually to effectuate suitable support for a sheet material used for recording When the user specifies the size and kind of sheet by the selecting operation or the like using the host computer for the purpose.

Here, the description will be made of the example using an ordinary paper, which is thin and not easy for ink to be dried thereon, and particularly, which is easier to allow ink yet to be fixed to be rubbed, when sheet materials P are stacked sequentially after recording on the expelled-sheet try 70 subsequent to the completion of each ink jet recording, which is made continuously on one sheet material P after another.

Figure 6A:
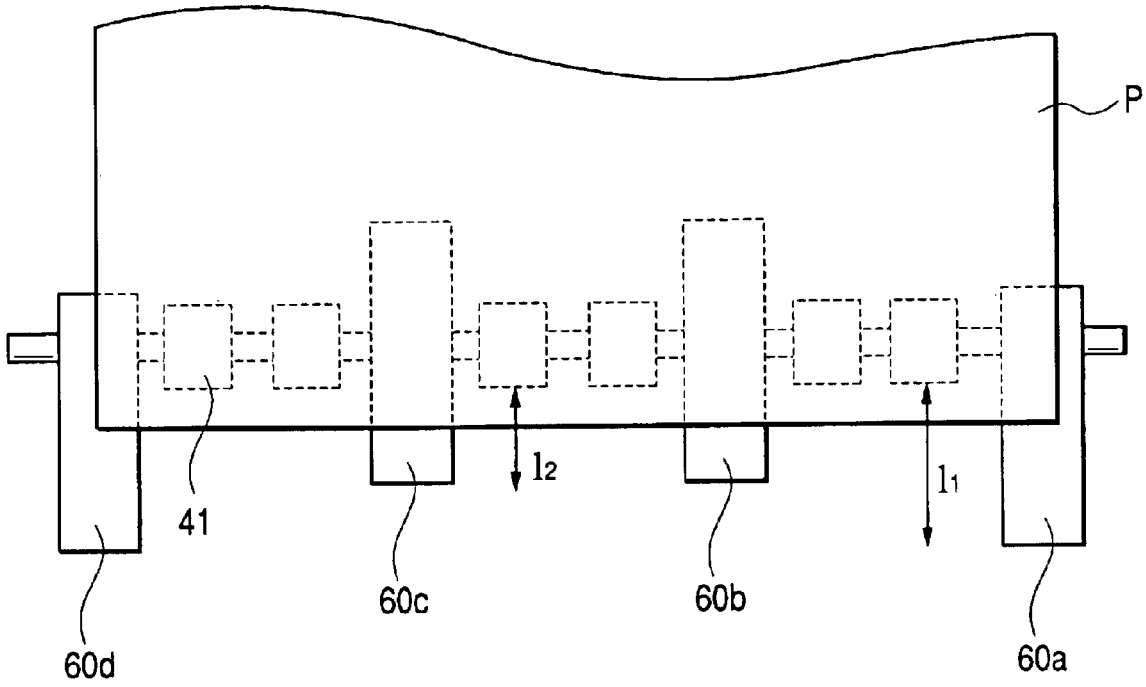
FIGS. 6A and 6B are a plan view and a front view, which schematically illustrate the length of extrusion of an expelled-sheet support in accordance with the first embodiment.
Figure 6B:
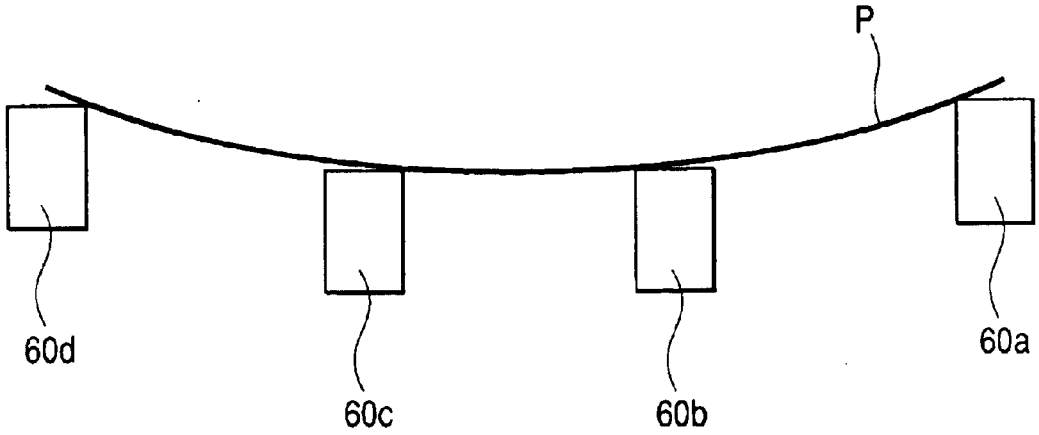

For example, FIGS. 6A and 6B illustrate the sheet expeller unit 4 when an A-3 sized ordinary paper is used as a sheet material P for recording. In this case, the length of the expelled-sheet support 60*a* and 60*d* is l1, and the length of the expelled-sheet supports 60*b* and 60*c* is l2, which is shorter than the length l1. Each of them is protruded. The position l1 is such as to support an ordinary paper in the direction higher than the almost horizontal direction with respect to the nipping point of the expeller roller pair 41 and 42 of the leading end of an ordinary paper conveyed by the conveying roller 36. The position l2 is such as to support an ordinary paper in the almost horizontal direction, which is lower than that.

With such arrangement, it becomes possible to take a form in which the central portion of an ordinary paper is bent downward in the widthwise direction when observed in the sheet expelling direction as compared with the case where all the expelled-sheet supports 60 are protruded in the length of l1. In this manner, firmness is given to the paper that serves as a sheet material. Further, it becomes possible to prolong a time during which the downward curving condition is kept in the air. Consequently, more time is obtainable before the ink on the preceding expelled sheet material P, which is yet to be fixed, is dried, thus preventing the image quality from being degraded due to rubbing of ink yet to be fixed.

Further, when a large amount of ink is discharged to a sheet material, such as paper, the amount of moisture given to the sheet material is also large, and the firmness of the sheet material is made small, thus making it impossible to keep the aforesaid bending condition any longer. However, the protruding length of the expelled-sheet supports 60*c* and 60*d* can be made larger than the l2 on the host computer side if it is determined that the amount of ink needed for that particular recording is extremely large. In this manner, it is possible to maintain the intended bending condition even in a state where the firmness of the sheet material is lost.

Figure 7A:
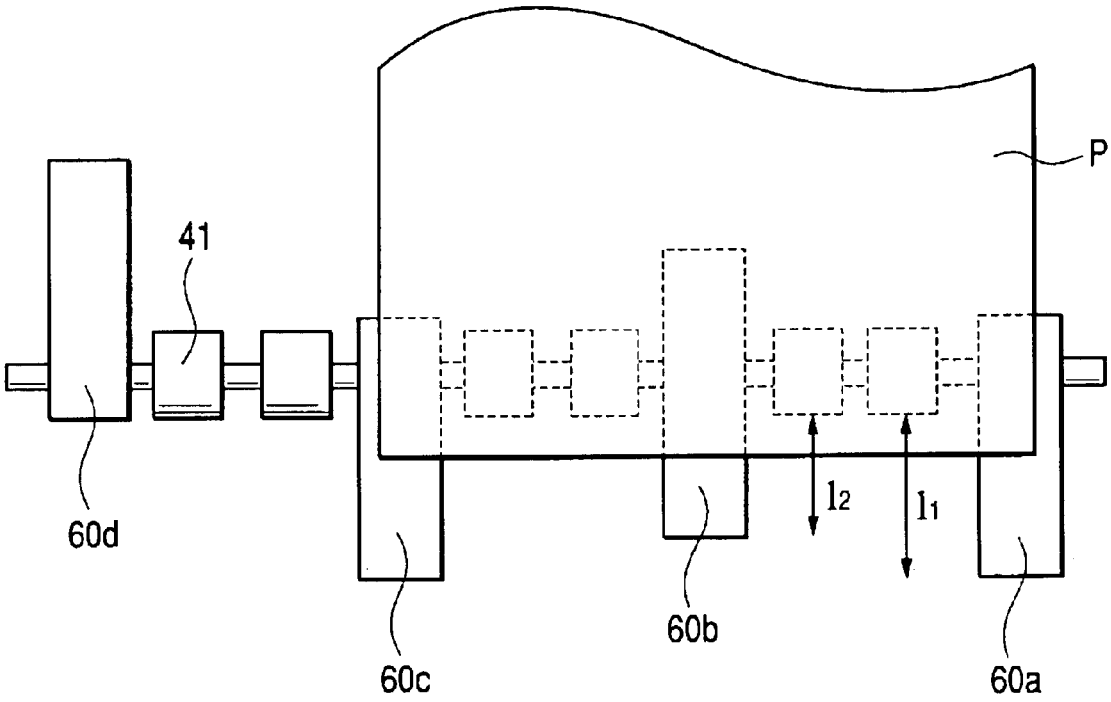
FIGS. 7A and 7B are a plan view and a front view, which schematically illustrate the length of extrusion of an expelled-sheet support in accordance with the first embodiment.
Figure 7B:
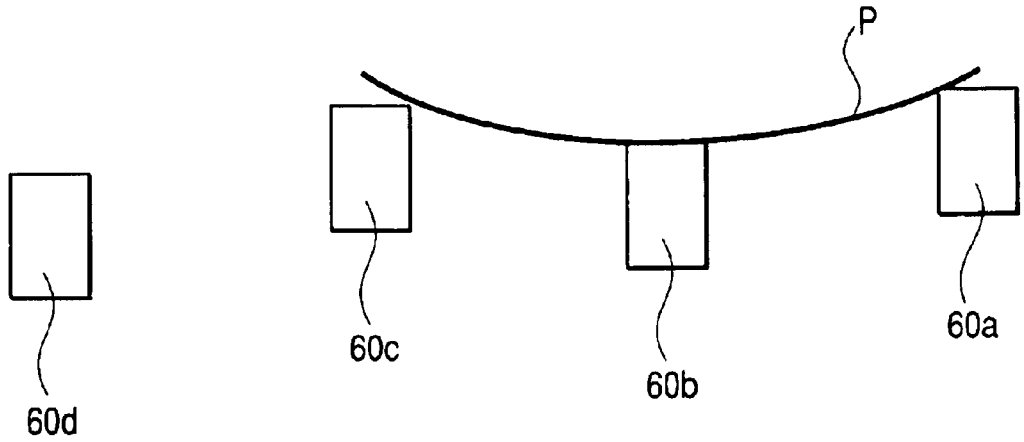

When an A-4 sized ordinary paper is used as a sheet material P, the expelled-sheet supports 60*a* and 60*c* are in the length of l1, the expelled-sheet support 60*b* is in the length of l2, and the expelled-sheet support 60*d* does not protrude as shown in FIGS. 7A and 7B. With this arrangement, it is possible to obtain the same effect as in the case of the A-3 sized ordinary paper as described above, while the user is not allowed to touch the expelled-sheet support 60*d*, because it does not protrude. As a result, there is no possibility that this device is damaged, such as damaging the expelled-sheet support unintentionally or the like.

Further, when a thick and specially treated sheet, for which high-quality ink jet recording is possible, is used as a sheet material P, there is almost no case where the image quality is degraded due to rubbing of ink yet to be fixed. Therefore, any one of the expelled-sheet supports 60 is not allowed to protrude or only the expelled-sheet support 60 is protruded in a small length on the portion to support a specially treated paper as shown in FIG. 4, thus making it possible to hold such specially treated paper almost horizontally.

Figure 8A:
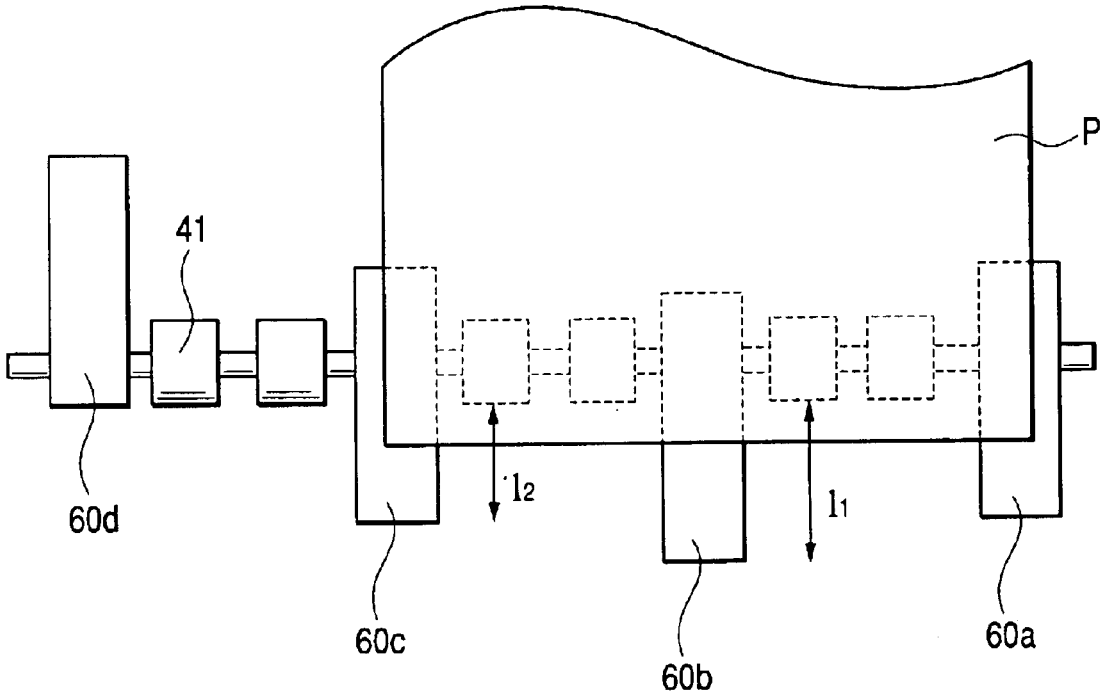
FIGS. 8A and 8B are a plan view and a front view, which schematically illustrate the length of extrusion of an expelled-sheet support in accordance with the first embodiment.
Figure 8B:
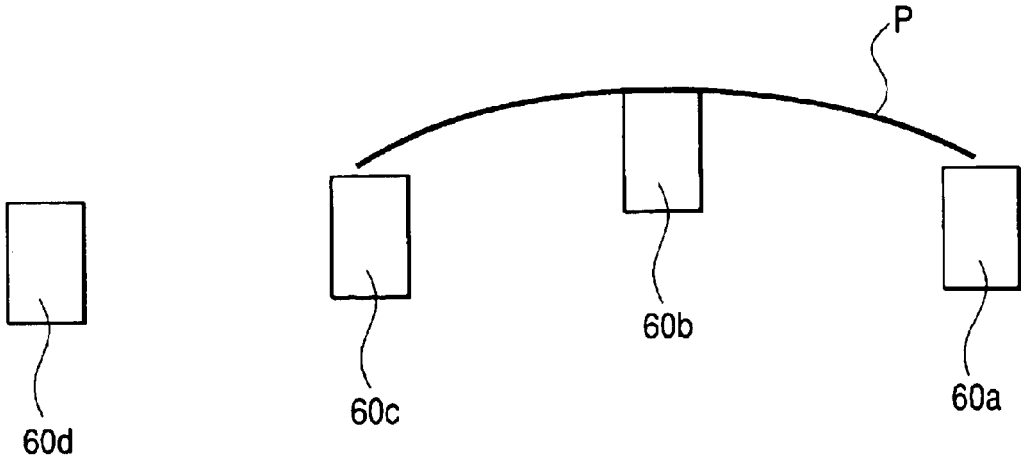

Also, there is a sheet material P, which is special and curved inversely to make the lower side upward as shown in FIGS. 8A and 8B when recording is made thereon. When the user selects such sheet material P beforehand, it is possible to enhance the holding capability of the sheet material P with respect to the curving condition thereof by arranging the expelled-sheet supports 60*a* and 60*c* in the length of l2, and the expelled-sheet support 60*b* in the length of l1, thus increasing the capability of retaining the curved condition of the sheet material P.

After the completion of recording, the extruded expelled-sheet supports 60 are retracted into the apparatus as a matter of course so that the sheet can be stacked on the expelled-sheet tray 70 reliably.

In the example described above, the expelled-sheet support 60 protrudes in a designated amount at once. As a result, the paper passage resistance becomes larger at once the moment it is protruded, and recording precision is often influenced. Therefore, at the initiation of recording, the amount of protrusion of the expelled-sheet support 60 is made as small as possible so that no paper passage resistance is present. Then, the amount of protrusion is increased gradually to make the resistance larger gradually. In this way, it is possible to make such influence smaller.

As has been described, the length of protrusion of the expelled-sheet support from the image forming apparatus is changed or the amount of protrusion is changed when the expeller-sheet support is protruded, hence making it possible to implement an optimal measure more reliably in accordance with the paper size, and the kind of paper as well.

(Second Embodiment)

Figure 9:
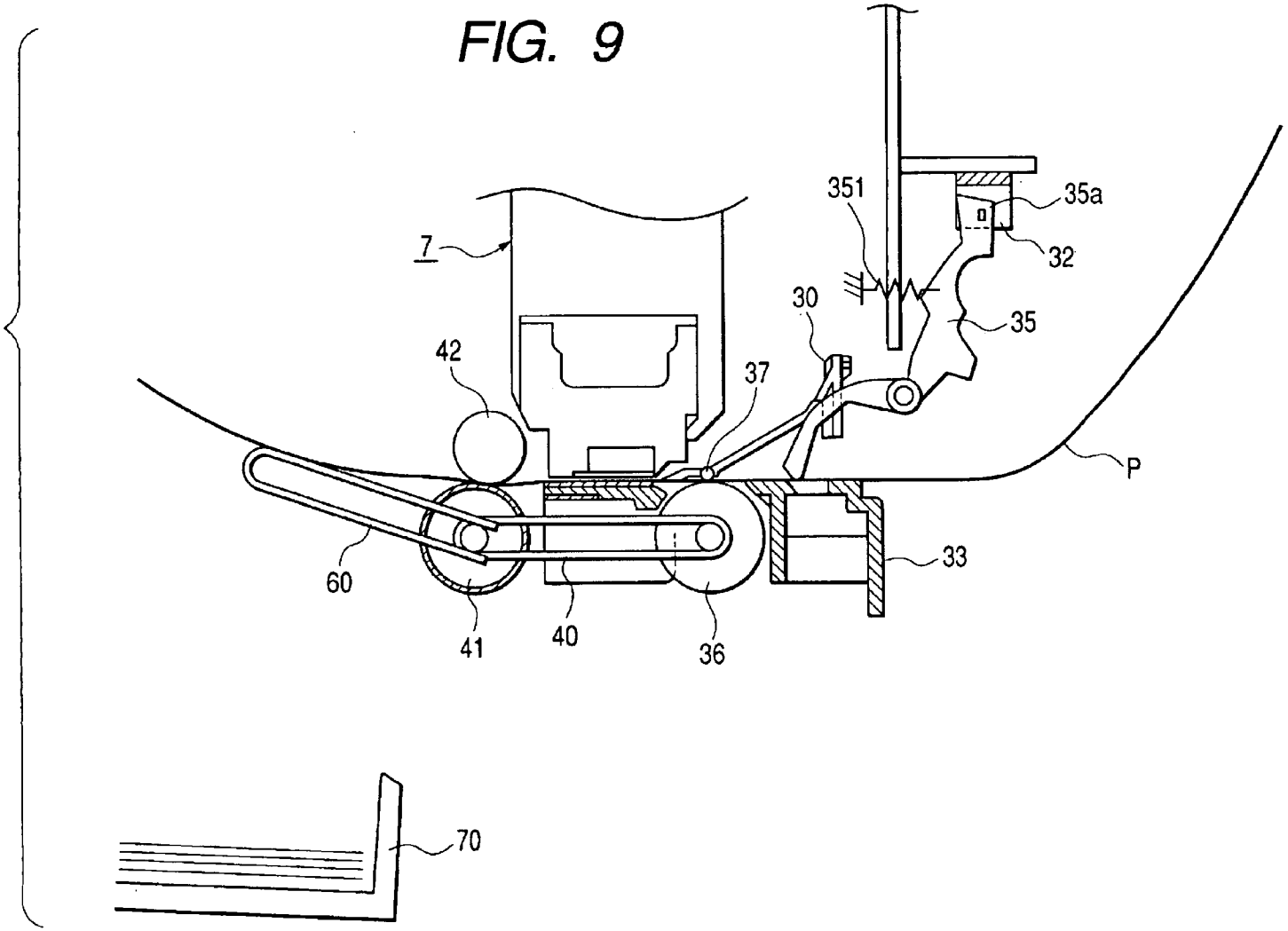
FIG. 9 is a cross-sectional view that schematically shows an image forming apparatus in accordance with a second embodiment of the present invention.
Figure 10:
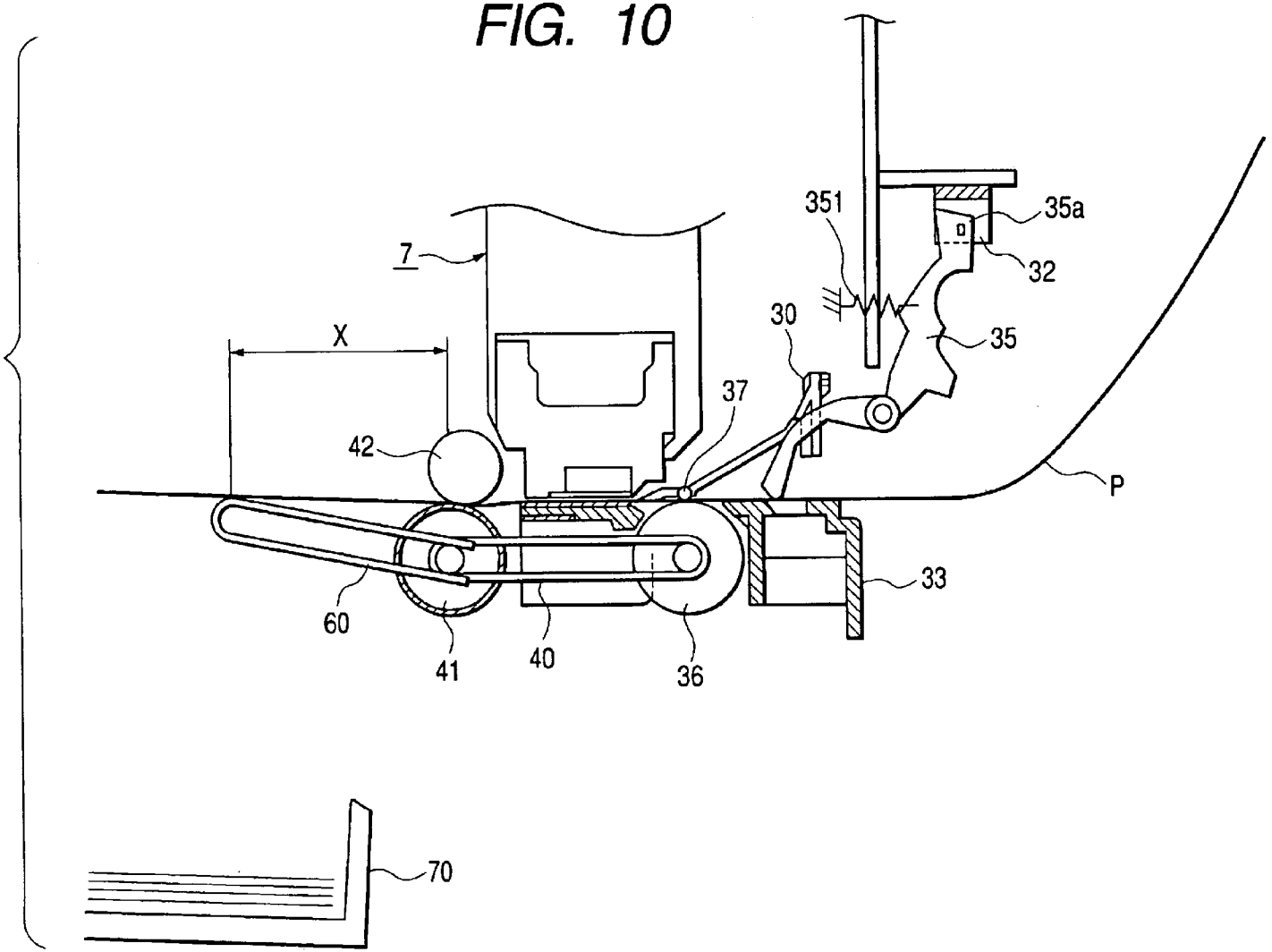
FIG. 10 is a cross-sectional view that schematically shows the image forming apparatus in accordance with the second embodiment.
Figure 11:
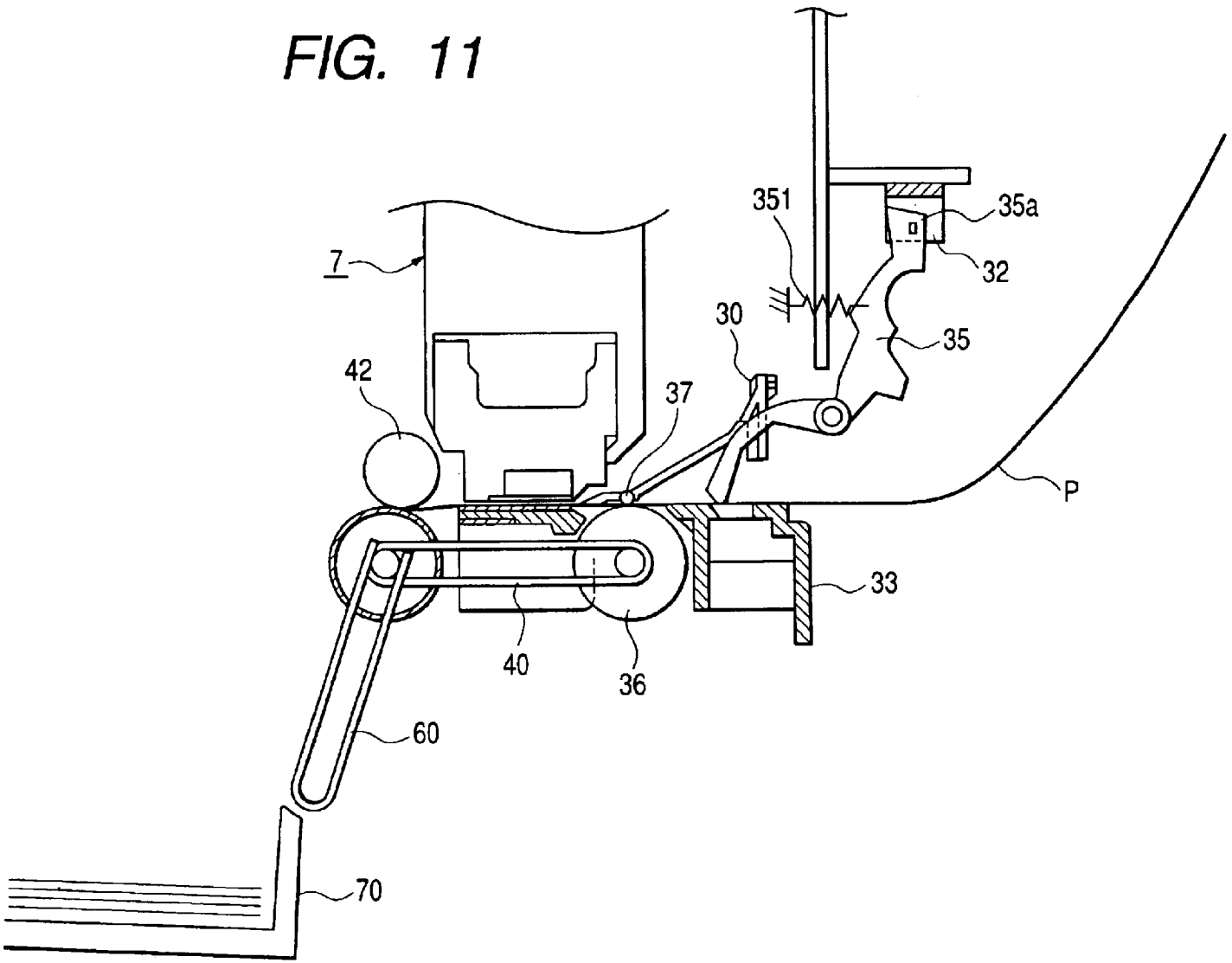
FIG. 11 is a cross-sectional view that schematically shows the image forming apparatus in accordance with the second embodiment.

FIG. 9, FIG. 10, and FIG. 11 are views that illustrate the operation of the expelled-sheet support 60 of the expeller unit 4 in accordance with a second embodiment.

The expelled-sheet support 60 of the first embodiment changes the curve holding conditions of a sheet material P optimally with the length of protrusion of the expelled-sheet support 60 in the direction a in FIG. 3 depending on each of the cases described. For a second embodiment to be described hereunder, the expelled-sheet support 60 is rotated along the curving direction of a sheet material P as shown in FIG. 9, FIG. 10, and FIG. 11 instead of being moved in the direction a, or more preferably, each of the expelled-sheet supports is rotated individually or displaced to determine the curve holding height of a sheet material P. In this case, when a sheet material P should be head almost horizontally as shown in FIG. 10, the sheet material, supporting distance x is longer than the first embodiment shown in FIG. 4. Therefore, the time to hold it in the air becomes longer accordingly, and as compared with the first embodiment, it becomes possible to secure the curve holding capability more for a sheet material in use.

Also, in accordance with the first embodiment, the expelled-sheet support 60 is retracted in order to stack a sheet material P on the expelled-sheet tray 70 when the recording is completed and the expeller conveyance of the sheet material P is over. At that time, the expelled-sheet support 60 moves in the direction opposite to the direction of the expeller conveyance of the sheet material P. As a result, there is a fear that the trailing end of the sheet material P is caught in the expeller roller pair 41 and 42.

In accordance with the second embodiment, the operational direction of the expelled-sheet support 60 is not related to the direction of expeller conveyance. Therefore, such event as to catch in the trailing end of a sheet material as described above does not take place, and also, the line formation of expelled sheets is significantly improved.

(Third Embodiment)

In accordance with the first and second embodiments, solenoids and stepping motors are used as the respective driving power sources to enable each of the expelled-sheet supports 60*a*, 60*b*, 60*c*, and 60*d* to operate individually. However, in accordance with a third embodiment, the arrangement is made to drive each of the expelled-sheet supports 60*a*, 60*b*, 60*c*, and 60*d* by use of one motor.

In this case, each of the pinion gears, which receive driving power from the motor, is arranged in such a manner that one and the same pinion gear is used for the expelled-sheet supports 60*a* and 60*d*, and the speed of the pinion gear used for the 60*c* is made slower than that of the pinion gear used for the 60*a* and 60*d*, and then, the speed of the pinion gear used for the 60*b* is made slower than the one used for the 60*c*.

Figure 12A:
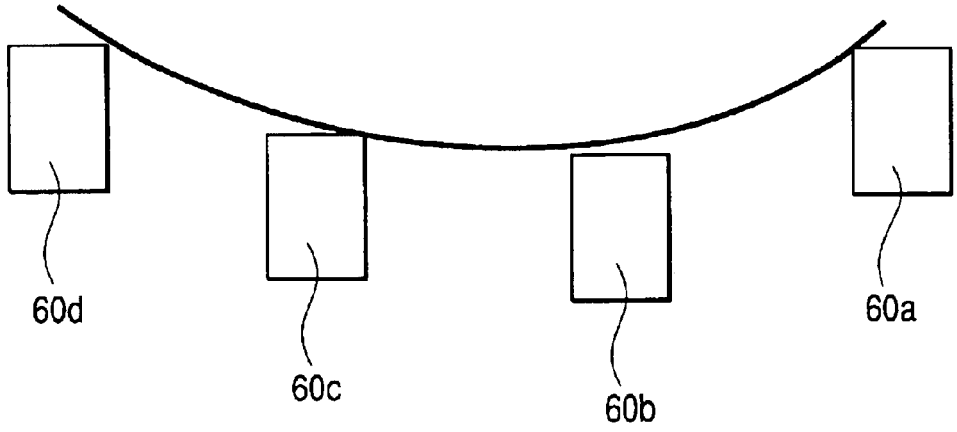
FIGS. 12A, 12B, and 12C are front views that schematically illustrate the supporting height of an expelled-sheet support in accordance with a third embodiment of the present invention.
Figure 12B:
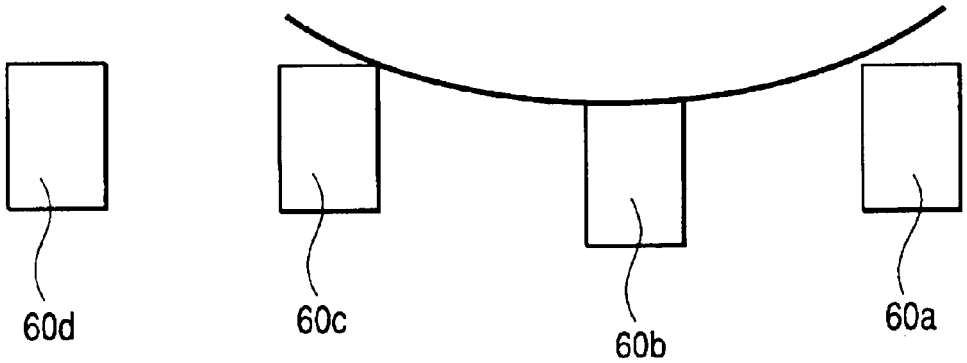
Figure 12C:
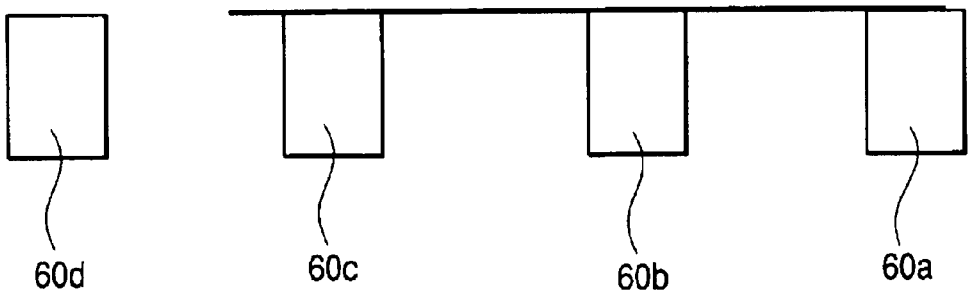

Also, a stopper is provided for each of the expelled-sheet supports 60*a*, 60*b*, 60*c*, and 60*d*, respectively, so that each of them is not allowed to operate more than a certain distance or angle. With this structure, it becomes possible to enable the supporting positions to be as shown in FIGS. 12A to 12C by means of driving time of a motor.

For example, a state where all of the four expelled-sheet supports are retracted (in a state where all the expelled-sheet supports are retracted) is effectively applicable to the thick paper dedicated for use of high-quality ink jet recording, which is not easy to degrade the image quality due to rubbing of ink yet to be fixed. The representation in FIG. 12A is effectively applicable to an A-3 sized ordinary paper; FIG. 12B is effectively applicable to an A-4 sized ordinary paper; and FIG. 12C is effectively applicable to the case where firmness is lost or the like because of a large amount of ink discharges.

In accordance with this embodiment, it becomes possible to hold a sheet material suitably in each case using different size of sheet material, quality thereof, discharge amount of ink, and the like with comparatively simple structure at low costs.

(Fourth Embodiment)

In each of the above embodiments, it has been described that the user designates size and kind of paper by operating selection or the like in a host computer as an example. Besides such example, it is possible to arrange the detection of size and kind of paper or the like by use of an optical sensor or the like provided for the recording head 7 or in the vicinity thereof (such as provided for a carriage that mounts a recording head 7 and moves serially) or arrange the detection of the amount of movement of the pinch roller corresponding to the thickness of a sheet material P depending on the thickness of the sheet material P inserted into the nipping portion of the conveying roller pair at the time of sheet feeding, or the like, for controlling the operation of expelled-sheet supports 60, or it may be possible to combine these examples as a measure to prevent image quality more reliably from being degraded due to rubbing of ink yet to be fixed.

As described above, in accordance with each of the embodiments, a sheet material in use is given an optically arranged curve depending on the size, material, thickness, and others of the sheet material when being expelled. Thus, it becomes possible to provide a sheet conveying device with a structure arranged as simple as possible at low costs, which is capable of preventing image quality from being degraded due to rubbing of ink yet to be fixed on the sheet material that has been expelled last by a sheet material being expelled following thereto, and also, to provide an image forming apparatus provided with such device.

What is claimed is:

1. A sheet material conveying device comprising:

a conveying mechanism for conveying a sheet material almost horizontally; and a plurality of supporting members movably attached to said conveying mechanism for supporting a sheet material, said plurality of supporting members being provided in the widthwise direction of conveyance substantially orthogonal to the conveying direction of sheet material, and at least one of said supporting members being capable of supporting a sheet material in a position having a height different from other of said supporting members in the direction substantially perpendicular to the sheet material, and further, the positions of at least one of said plurality of supporting members for supporting a sheet material being variable substantially in the same direction as the conveying direction of sheet material.

2. A sheet conveying device according to claim 1, wherein at least two of said supporting members are movable individually.

3. A sheet conveying device according to claim 1, wherein said supporting member moves to different positions in accordance with the area of conveyance of a sheet material having different size.

4. A sheet conveying device according to claim 1, wherein said supporting member moves to different positions in accordance with the material of a sheet material.

5. A sheet conveying device according to claim 1, wherein said supporting member moves to different positions in accordance with the thickness of a sheet material.

6. A sheet material conveying device comprising:

a conveying mechanism for conveying a sheet material almost horizontally; and a plurality of supporting members movably attached to said conveying mechanism for supporting a sheet material, said plurality of supporting members being provided in the widthwise direction of conveyance substantially orthogonal to the conveying direction of sheet material, and at least one of said supporting members being capable of supporting a sheet material in a position having a height different from other of said supporting members in the direction substantially perpendicular to the sheet material, and further, the positions of at least one of said plurality of supporting members for supporting a sheet material being variable substantially in the direction substantially perpendicular to the conveying plane of sheet material.

7. A sheet conveying device according to claim 6, wherein at least two of said supporting members are movable individually.

8. A sheet conveying device according to claim 6, wherein said supporting member moves to different positions in accordance with the area of conveyance of a sheet material having different size.

9. A sheet conveying device according to claim 6, wherein said supporting member moves to different positions in accordance with the material of a sheet material.

10. A sheet conveying device according to claim 6, wherein said supporting member moves to different positions in accordance with the thickness of a sheet material.

11. An image forming apparatus for forming images on a sheet material by use of a recording head comprising:

a conveying mechanism for conveying a sheet material almost horizontally; and a plurality of supporting members movably attached for supporting a sheet material conveyed by said conveying mechanism on the downstream side of the position for effectuating the image formation on the sheet material by said recording head, said plurality of supporting members being provided in the widthwise direction of conveyance substantially orthogonal to the conveying direction of sheet material, and at least one of said supporting members being capable of supporting a sheet material in a position having a height different from other of said supporting members in the direction substantially perpendicular to the sheet material, and further, the positions of at least one of said plurality of supporting members for supporting a sheet material being variable substantially in the same direction as the conveying direction of sheet material.

12. An image forming apparatus according to claim 11, wherein at least two of said supporting members are movable individually.

13. An image forming apparatus according to claim 11, wherein said supporting member moves to different positions in accordance with the area of conveyance of a sheet material having different size.

14. An image forming apparatus according to claim 11, wherein said supporting member moves to different positions in accordance with the material of a sheet material.

15. An image forming apparatus according to claim 11, wherein said supporting member moves to different positions in accordance with the thickness of a sheet material.

16. An image forming apparatus for forming images on a sheet material by use of a recording head comprising:

a conveying mechanism for conveying a sheet material almost horizontally; and a plurality of supporting members movably attached for supporting a sheet material conveyed by said conveying mechanism on the downstream side of the position for effectuating the image formation on the sheet material by said recording head, said plurality of supporting members being provided in the widthwise direction of conveyance substantially orthogonal to the conveying direction of sheet material, and at least one of said supporting members being capable of supporting a sheet material in a position having a height different from other of said supporting members in the direction substantially perpendicular to the sheet material, and further, the positions of at least one of said plurality of supporting members for supporting a sheet material being variable substantially in the direction substan tially perpendicular to the conveying plane of sheet material.

17. An image forming apparatus according to claim 16, wherein at least two of said supporting members are movable individually.

18. An image forming apparatus according to claim 16, wherein said supporting member moves to different positions in accordance with the area of conveyance of a sheet material having different size.

19. An image forming apparatus according to claim 16, wherein said supporting member moves to different positions in accordance with the material of a sheet material.

20. An image forming apparatus according to claim 16, wherein said supporting member moves to different positions in accordance with the thickness of a sheet material.

21. A sheet conveying device comprising:

a roller for conveying a sheet material in a substantially horizontal direction; and at least three or more supporting members for supporting the sheet material conveyed by said roller, a position where said supporting member supports the sheet material being movable, wherein two of said supporting members support both ends of the sheet material and another said supporting member supports the sheet material at a height different from said two supporting members between said two supporting members supporting both ends of the sheet material.

* * * * *

UNITED STATES PATENT AND TRADEMARK OFFICE

CERTIFICATE OF CORRECTION

PATENT NO. : 6,793,216 B2
DATED : September 21, 2004
INVENTOR(S) : Takao Nakamura It is certified that error appears in the above-identified patent and that said Letters Patent is hereby corrected as shown below:

Column 5,
Line 50, “try” should read -- tray --.

Column 6,
Line 27, “try” should read -- tray --.

Column 9,
Line 15, “simple” should read -- simply --.

Signed and Sealed this

First Day of February, 2005

JON W. DUDAS
*Director of the United States Patent and Trademark Office*